US012286909B2

(12) United States Patent
Metsack et al.

(10) Patent No.: US 12,286,909 B2
(45) Date of Patent: Apr. 29, 2025

(54) ROCKER ARM WITH A RESET SLIDER DISPOSED IN A LASH ADJUSTMENT ASSEMBLY

(71) Applicant: Jacobs Vehicle Systems, Inc., Bloomfield, CT (US)

(72) Inventors: Austen P. Metsack, Ashford, CT (US); Gabriel S. Roberts, Wallingford, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 18/589,518

(22) Filed: Feb. 28, 2024

(65) Prior Publication Data

US 2024/0287920 A1 Aug. 29, 2024

Related U.S. Application Data

(60) Provisional application No. 63/487,341, filed on Feb. 28, 2023.

(51) Int. Cl.
*F01L 1/24* (2006.01)
*F01L 1/18* (2006.01)
(Continued)

(52) U.S. Cl.
CPC ..... *F01L 1/2416* (2013.01); *F01L 1/181* (2013.01); *F01L 1/182* (2013.01); *F01L 1/2411* (2013.01);
(Continued)

(58) Field of Classification Search
CPC . F01L 1/181; F01L 1/2411; F01L 2001/2444; F01L 1/26; F01L 13/06; F01L 13/065
(Continued)

(56) References Cited

U.S. PATENT DOCUMENTS 6,386,160 B1 5/2002 Meneely et al.
9,752,471 B2 9/2017 Meneely et al.
(Continued)

FOREIGN PATENT DOCUMENTS

CN 213016479 U 4/2021
JP 7-247812 A 9/1995
(Continued)

OTHER PUBLICATIONS

International Search Report for International Application No. PCT/IB2024/051917; mailed May 21, 2024; 3 pages.
(Continued)

*Primary Examiner* — Jorge L Leon, Jr.
(74) *Attorney, Agent, or Firm* — Jordan IP Law, LLC

(57) ABSTRACT

A rocker arm comprises an actuator piston slidably disposed in an actuator piston bore formed in a motion imparting end thereof. A lash adjustment assembly is disposed in the motion imparting end and comprises an internal bore. A hydraulic passage is in fluid communication with the actuator piston bore and the internal bore. A resetting assembly is disposed in the lash adjustment assembly and comprises a reset slider and a checking element in fluid communication with the internal bore. The reset slider is slidably disposed in the internal bore and has a first end configured to engage a valve train component or engine valve, and has a second end with a resetting pin disposed thereon configured to contact and place the checking element in an unchecked state in response to positioning of the rocker arm when the first end contacts the valve train component or engine valve.

18 Claims, 10 Drawing Sheets

(51) Int. Cl.
*F01L 1/26* (2006.01)
*F01L 13/06* (2006.01)

(52) U.S. Cl.
CPC ..... *F01L 1/26* (2013.01); *F01L 2001/2444* (2013.01); *F01L 13/06* (2013.01); *F01L 13/065* (2013.01)

(58) Field of Classification Search
USPC ..... 123/90.4, 90.44, 90.46
See application file for complete search history.

(56) References Cited

U.S. PATENT DOCUMENTS

| | | | | |
|---|---|---|---|---|
| 2013/0042835 | A1* | 2/2013 | Hansson | F01L 1/182 123/90.12 |
| 2014/0083381 | A1 | 3/2014 | Roberts et al. | |
| 2014/0182536 | A1 | 7/2014 | Yang | |
| 2015/0144096 | A1 | 5/2015 | Meneely et al. | |
| 2016/0356187 | A1* | 12/2016 | Meneely | F01L 13/06 |
| 2019/0145289 | A1 | 5/2019 | Ferreira | |
| 2019/0309664 | A1* | 10/2019 | Batcheller | F01L 1/181 |
| 2022/0307392 | A1* | 9/2022 | Taylor | F01L 1/267 |

FOREIGN PATENT DOCUMENTS

| | | | |
|---|---|---|---|
| JP | 2008-128151 | A | 6/2008 |
| JP | 2011-149398 | A | 8/2011 |
| JP | 2022-123263 | A | 8/2022 |
| WO | 2013014490 | A1 | 1/2013 |

OTHER PUBLICATIONS

Written Opinion of the International Searching Authority for International Application No. PCT/IB2024/051917; mailed May 21, 2024; 3 pages.

* cited by examiner

-Prior Art-

ROCKER ARM WITH A RESET SLIDER DISPOSED IN A LASH ADJUSTMENT ASSEMBLY

FIELD

The present disclosure relates generally to rocker arms for use in internal combustion engines and, in particular, to a rocker arm comprising a reset slider disposed in a lash adjustment assembly.

BACKGROUND

Internal combustion engines typically use either a mechanical, electrical, or hydro-mechanical valve actuation systems to actuate the engine valves. These systems may include a combination of camshafts, rocker arms, push rods, valve bridges, etc. (each, a valve train component and, collectively, a valve train) that may be driven by the engine's crankshaft rotation. When a camshaft is used to actuate the engine valves, i.e., acting as a valve actuation motion source, the timing of the valve actuation motions may be fixed by the size and location of the lobes on the camshaft.

As known in the art, valve actuations may comprise so-called main valve actuation motions and/or auxiliary valve actuation motions. As used herein, the descriptor "main" refers to engine valve motions used during positive power generation in which fuel is combusted in an engine cylinder to provide a net output of engine power, whereas the descriptor "auxiliary" refers to other engine valve motions for purposes that are alternative to positive power generation (e.g., compression-release braking, bleeder braking, cylinder decompression, cylinder deactivation, brake gas recirculation (BGR), etc.) or in addition to positive power generation (e.g., internal exhaust gas recirculation (IEGR), variable valve actuations (VVA), early exhaust valve opening (EEVO), late intake valve closing (LIVC), swirl control, etc.).

Engine braking has conventionally been implemented using, for any given cylinder, a dedicated braking rocker arm for conveying auxiliary valve actuation motions (e.g., compression-release valve actuations) that is separate from the exhaust rocker arm used to convey main exhaust valve actuations to exhaust engine valves. More recent developments include the so-called integrated rocker brake (IRB) in which the dedicated braking rocker arm and exhaust rocker arm are combined into one rocker arm for cost savings as well as provision of more compact valvetrain hardware.

As known in the art, and with reference to FIG. 1, an IRB 100 typically includes a nose or motion imparting end of the rocker arm configured to transfer main event valve actuation motions through a valve bridge 102 to a pair of engine valves 104 and a selectable actuator 106 configured to transfer auxiliary (e.g., engine braking) valve actuation motions to only one of the engine valves 104*b* via a bridge pin 108 in the valve bridge 102. A single valve actuation motion source 110, e.g., a cam, is provided that includes lobes for both main event valve actuations and engine braking valve actuations (or other auxiliary valve actuations). An example of such a cam is illustrated in FIG. 2, which shows a cam 240 comprising a main valve actuation cam lobe 242 and, in the illustrated example, two auxiliary valve actuation cam lobes 244*a*, 244*b*.

As known in the art, and referring once again to FIG. 1, the IRB 100 is typically maintained in contact with the valve actuation motion source 110 such that all valve actuation motions provided by the valve actuation motion source 110 (both main and auxiliary) are received by the rocker arm 100. As further shown in FIG. 1, control of the actuator 106 in a typical IRB configuration is provided by a selectable hydraulic fluid supply 112 operated to provide hydraulic fluid to a control valve 114 (or, in alternative embodiments, via a check valve). In the absence of hydraulic fluid supplied to the control valve 114, an actuator piston of the actuator 106 is maintained in a retracted or compliant state such that no valve actuations, main or auxiliary, are conveyed by the actuator 106 to the bridge pin 108 and engine braking valve 104*b*. At the same time, auxiliary valve actuation motions applied to the rocker arm 100 are lost through a lost motion mechanism (not shown) such that only main valve actuation motions are conveyed to the valve bridge 102 and thereafter onto the engine valves 104.

On the other hand, when auxiliary operation is desired, hydraulic fluid is supplied to the control valve 114 and the hydraulic fluid is, in turn, supplied to a high pressure chamber 116 in fluid communication with the actuator piston of the actuator 106. The control valve 114 also serves to check the hydraulic fluid in the high pressure chamber 116, thereby maintaining a hydraulic lock on the fluid in the high pressure chamber 116, which causes the actuator piston to remain in an extended state throughout the engine braking valve actuation motions, thereby delivering auxiliary valve actuation motions to the auxiliary valve 104*b* via the bridge pin 108.

An IRB valvetrain does have several concerns regarding valve-to-piston contact and seating velocity. Regarding the former, if the actuator piston remains in its extended state during a main event valve actuation, the engine valves 104 will experience lift beyond the main event valve actuation, thereby causing the engine valves 104 to extend further into the cylinder bore and potentially leading to catastrophic contact between the piston and engine valves 104. One solution to this problem is to budget more room in the piston bore or less of a piston stroke in order to avoid contact with the engine valves 104. However, this solution is undesirable because engine braking power would be reduced due to the reduced volume in both the compression and exhaust strokes. Regarding the latter, seating velocity is another concern due to the braking component of the rocker causing a higher seating velocity of the non-braking valve. High seating velocities can result in accelerated seat wear as well as potential failure of valves or seats.

One way to combat these problems, as known in the art, is to incorporate a reset assembly 118 into the IRB system as further shown in FIG. 1. Often, a reset assembly 118 is provided by one or more components external to the IRB 100 as illustrated in FIG. 1. Alternatively, a reset assembly 118' may be incorporated into the IRB 100 itself. Regardless, such reset assemblies 118, 118' generally operate by providing a hydraulic connection 120, 120' that can be controlled (typically by virtue of angular position of the rocker arm 100 relative to another valve train component or fixed surface) to selectively and rapidly vent the high pressure chamber 116, thereby causing the actuator piston to retract or collapse and to transfer control of the engine brake valves 104 to the main event valve actuation motion and thus prevent overextension thereof as well as preventing high seating velocities of non-braking valves.

Notwithstanding the above-noted benefits, current IRB systems that include resets have issues including the system coming out of the reset mode while still in the main event motion, which can reduce, or even completely obviate, the benefits of the reset. Additionally, IRB systems, particularly those that are external to the IRB, are typically bulky with a lot of components, thereby adding undesirable weight and expense and further making packaging of such systems more difficult.

SUMMARY

The above-noted shortcomings of prior art solutions are addressed through the provision of a rocker arm for actuating at least one engine valve in an internal combustion engine. In an embodiment, the rocker arm comprises an actuator piston slidably disposed in an actuator piston bore formed in a motion imparting end of the rocker arm. A lash adjustment assembly is disposed in the motion imparting end of the rocker arm and comprises an internal bore. A hydraulic passage is provided in the rocker arm in fluid communication with the actuator piston bore and the internal bore of the lash adjustment assembly. A resetting assembly is disposed in the lash adjustment assembly. The resetting assembly comprises a reset slider and a checking element in fluid communication with the internal bore. The reset slider is slidably disposed in the internal bore and has a first end and a second end. The first end of the reset slider is configured to engage a valve train component or engine valve of the at least one engine valve and the second end of the reset slider has a resetting pin disposed thereon configured to contact and place the checking element in an unchecked state in response to positioning of the rocker arm when the first end contacts the valve train component or engine valve.

In an embodiment, the actuator piston bore is configured to receive hydraulic fluid from a hydraulic fluid source. The hydraulic fluid source may comprise a check valve, which check valve may be further disposed within a control valve.

In an embodiment, the actuator piston in disposed to align with a first valve of the at least one engine valve. The actuator piston may be disposed at a position closer to a motion receiving end of the rocker arm than the lash adjustment assembly. In another embodiment, the actuator piston may be inwardly biased in the actuator bore.

In an embodiment, the lash adjustment assembly comprises a lash adjustment screw threadedly mounted in the rocker arm, the lash adjustment screw comprising a radial bore in fluid communication with the internal bore and configured to register with the hydraulic passage. The internal bore may comprise a first bore and a second bore with an opening therebetween, wherein the radial bore is in fluid communication with the first bore and wherein the checking element is configured, in a checked state, to hydraulically isolate the first bore from the second bore. In this embodiment, a width of the resetting pin may be less than a width of the opening such that fluid communication between the first and second bores is established when the checking element is in the unchecked state.

In an embodiment, the reset slider is configured to lose at least a portion of valve actuation motions applied to the rocker arm before contacting the checking element. For example, the reset slider may be configured to lose auxiliary valve actuation motions applied to the rocker arm. Further to this embodiment, the reset slider may comprise a diametrically and longitudinally extending notch configured to define the portion of valve actuation motions lost by the reset slider. Further still, the lash assembly may comprise a transverse pin configured to engage the notch and limit at least some movement of the reset slider.

In an embodiment, the rocker arm further comprises a biasing element configured to bias the reset slider out of the internal bore. The biasing element may provide a bias sufficient to urge the rocker arm into contact with a valve actuation motion source when the reset slider contacts the valve train component or engine valve.

In an embodiment, the at least one engine valve comprises two engine valves, and the valve train component is a valve bridge operative connected to the two engine valves.

In an embodiment, the lash adjustment assembly comprises a venting passage in fluid communication with the internal bore and configured such that, when the resetting pin places the checking element in the unchecked state, hydraulic fluid in the actuator piston bore passes through the venting passage to an ambient environment.

In an embodiment, the reset slider comprises an e-foot movably attached to the second end of the reset slider and configured to contact the valve train component or engine valve.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

As used herein, phrases substantially similar to "at least one of A, B or C" are intended to be interpreted in the disjunctive, i.e., to require A or B or C or any combination thereof unless stated or implied by context otherwise. Further, phrases substantially similar to "at least one of A, B and C" are intended to be interpreted in the conjunctive, i.e., to require at least one of A, at least one of B and at least one of C unless stated or implied by context otherwise. Further still, the term "substantially" or similar words requiring subjective comparison are intended to mean "within manufacturing tolerances" unless stated or implied by context otherwise.

As used herein, the phrase "operatively connected" refers to at least a functional relationship between two elements and may encompass configurations in which the two elements are directly connected to each other, i.e., without any intervening elements, or indirectly connected to each other, i.e., with intervening elements.

The instant disclosure describes a cost friendly, rocker arm, specifically, an integrated rocker brake, that includes a resetting assembly incorporated into the rocker arm, particularly within lash adjustment assembly. The techniques described herein do not require any external reset assemblies (e.g., pedestals or contact pads) and yet provides the ability to reset valve actuations throughout the entirety of main valve actuation motions. Additionally, the rocker arm described herein may include an integrated biasing element to maintain the rocker arm in contact with the motion source, thereby avoiding the need for any external biasing component. The resetting assembly is preferably stroke limited to allow for ease of lash adjustment and minimize valve spring preload reduction between sub-base and base circle.

Figure 1:
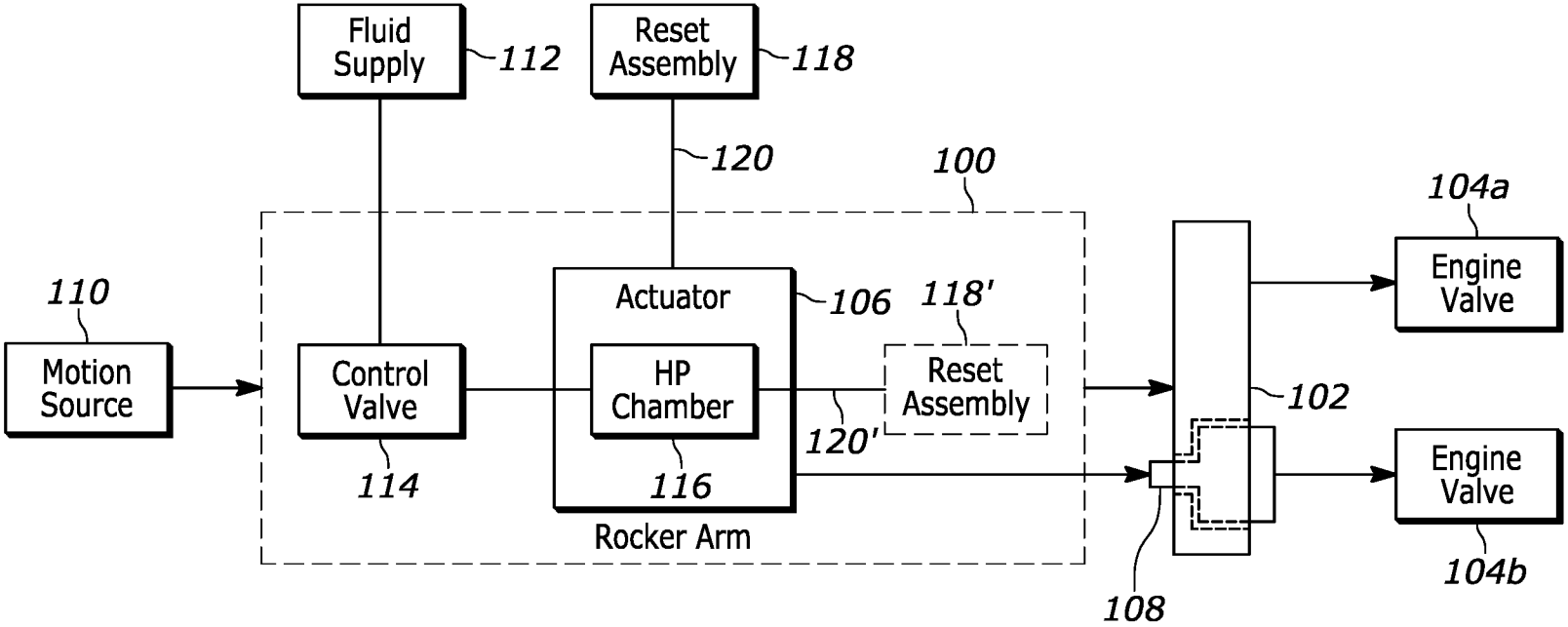
FIG. 1 is schematic illustration of an IRB system in accordance with prior art techniques.
Figure 2:
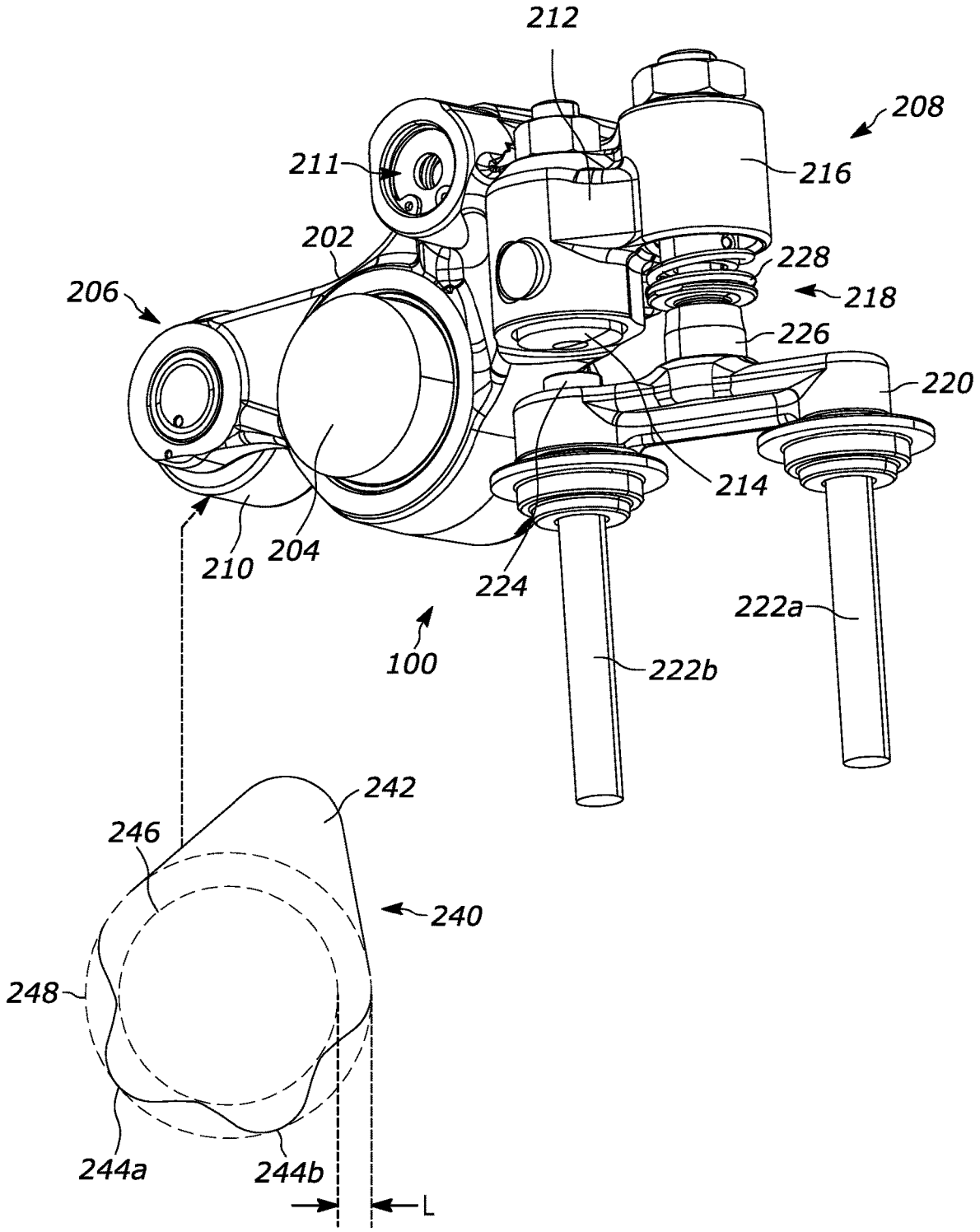
FIG. 2 is a schematic and perspective side view of an IRB system in accordance with the instant disclosure.

Referring to FIG. 2, a valve actuation system 200 comprising a rocker arm or IRB 202 is illustrated. The rocker arm 202 is mounted on a rocker shaft 204 and has a motion receiving end 206 and a motion imparting end 208. In accordance with known techniques, the rocker shaft 204 includes hydraulic passages (not shown) for supplying both constant and selectable hydraulic fluid to the rocker arm 202. Although the rocker arm 200 is illustrated as a center pivot rocker arm, the teachings of the instant application may be equally applied to other types of rocker arms, such as end pivot rocker arms. The motion receiving end 206 of the rocker arm 202 includes a roller 210 configured to align with a single valve actuation motion source 240 in order to receive both main event and auxiliary valve actuation motions. As will be appreciated by those skilled in the art, the roller 210 may instead be implemented using other mechanisms, such a tappet or contact surface.

In the illustrated embodiment, the motion imparting end 208 of the rocker arm 202 includes a control valve 211, an actuator boss 212 having an actuator piston 214 disposed therein, and a lash/reset assembly boss 216 having a resetting assembly 218 disposed therein. In an embodiment, the actuator boss 212, and therefore the actuator piston 214, is positioned closer to the motion receiving end 206 of the rocker arm 202 than the lash/reset assembly boss 216, and therefore the resetting assembly 218. However, it is appreciated that this position of the actuator piston 214 relative to the resetting assembly 218 is not a requirement.

The system further comprises a valve bridge 220 that spans two engine valves 222, which valves could be either exhaust or intake valves. The lash/reset assembly boss 216 and resetting assembly 218 are configured to align with a center of the valve bridge 220, whereas the actuator boss 212 and actuator piston 214 are configured to align with a bridge pin 224 disposed within the valve bridge 220 that, in turn, aligns with a first engine valve 222*b*. The resetting assembly 218 comprises a swivel or so-called e-foot 226 that, as described below, is maintained in constant contact with the valve bridge 220 (or other valve train component or engine valve of the two engine valves 222) due to a bias force applied by a biasing element 228, which force also biases the motion receiving end 206 of the rocker arm 202 (via the roller 210) into contact with the valve actuation motion source 240.

The valve actuation motion source 240 is provided as a cam having cam lobes 242, 244 defined according to a so-called base circle 246 and sub-base circle 248. In accordance with known techniques, the base circle 246 and sub-base circle 248 are separated by a distance, L, defining a maximum height for auxiliary valve actuation cam lobes 244 provided on the cam 240. Such auxiliary lobes 244, though resulting in auxiliary valve actuation motions in the rocker arm 202 are only selectively conveyed by the actuator piston 214 and are absorbed, in all instances, by the resetting assembly 218 as described in further detail below. On the other hand, any portions of cam lobes greater than the height of the sub-base circle 248, e.g., the main valve actuation cam lobe 242, are conveyed by the resetting assembly 218 in all instances, and also cause reset of the actuator piston 214 during periods of auxiliary operation, e.g., engine braking, again as described in greater detail below.

That is, as shown in FIG. 2, in the absence of hydraulic fluid being supplied thereto via the control valve 211, thereby operating the rocker arm 202 in a conventional or power generating mode, the actuator piston 214 is maintained in a retracted position such that it will not make contact with the bridge pin 224 and is therefore prevented from conveying any valve actuation motions to the first engine valve 222*b*. As described in further detail below, the resetting assembly 218, in the absence of hydraulic fluid applied to the actuator piston 214, is configured to absorb any auxiliary valve actuation motions applied thereto but to convey any main event valve actuation motions applied thereto to the valve bridge 220 and engine valves 222.

On the other hand, when hydraulic fluid is supplied to the actuator piston 214 via the control valve 211, the actuator piston 214 will be maintained in an extended position (due to a locked volume of hydraulic fluid) during any auxiliary motion applied to the rocker arm 202. Such auxiliary valve actuation motions will induce contact between the actuator piston 214 and bridge pin 224 such that the auxiliary valve actuation motions are conveyed to the first engine valve 222*b*. At the same time, the lost motion capability of the resetting assembly 218 will prevent the auxiliary valve actuation motions from being conveyed to the center of the valve bridge 220. However, when a main event valve actuation motion is received by the rocker arm 202, the resetting assembly 218 will operate to cause the retraction (reset) of the actuator piston 214 such that both engine valves 222 are commanded solely through conveyance of the main event valve actuation through the resetting assembly 218 and valve bridge 220.

Figure 3:
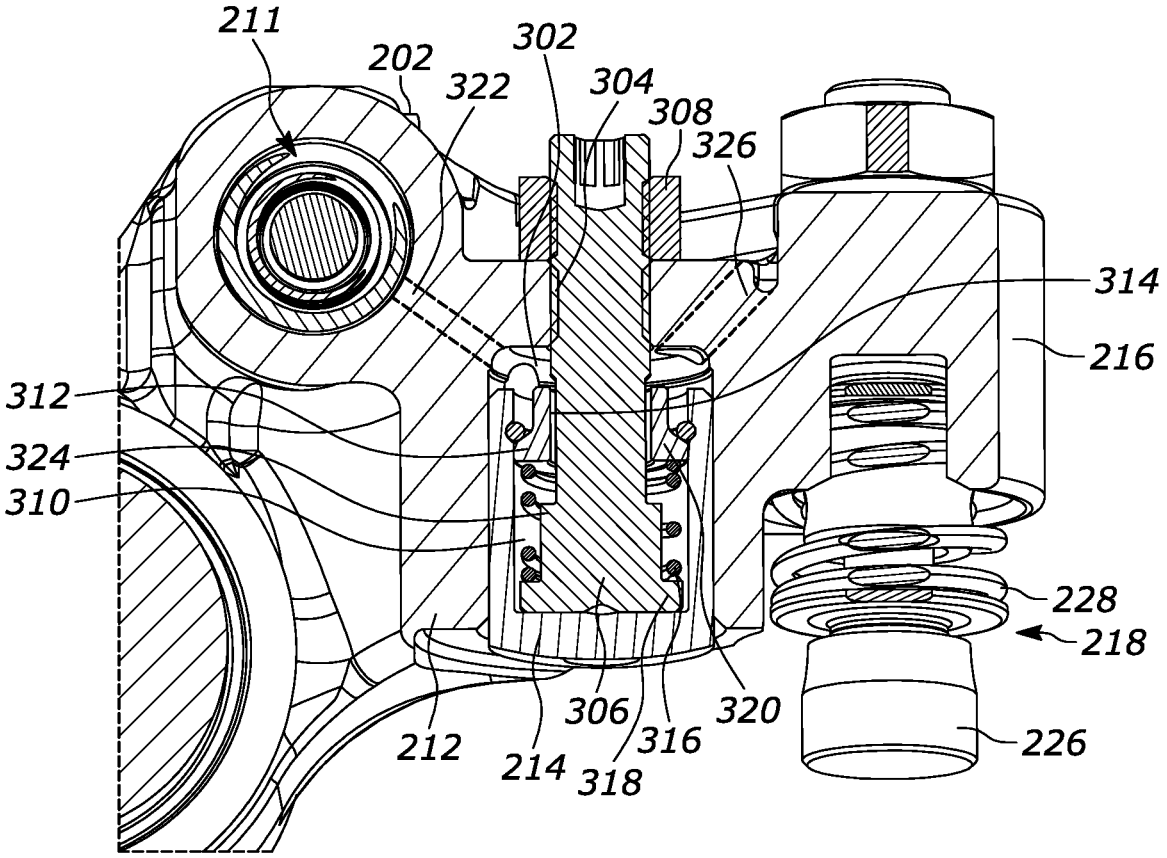
FIGS. 3 and 4 are partial elevational cross-section views of a rocker arm shown in FIG. 2 and illustrating further details of an actuator and resetting assembly in accordance with the instant disclosure.

Referring now to FIG. 3, a partial cross-section illustrating additional detail of the actuator boss 212 and actuator piston 214 is shown. In particular, the actuator boss 212 comprises an actuator piston bore 302 formed therein having the actuator piston 214 slidably disposed in an open end thereof. A threaded opening 304 is provided at an opposite end of the actuator piston bore 302 and an actuator lash adjustment screw 306 is threadedly engaged with the opening 304. As known in the art, an actuator lash adjustment nut 308 is threadedly engaged with the actuator lash adjustment screw 306 in order to maintain positioning of the actuator lash adjustment screw 306 within the actuator piston bore 302. A distal end (relative to the actuator lash adjustment nut 308) of the actuator lash adjustment screw 306 extends into an inner bore 310 formed in the actuator piston 214. A retainer 312 is attached to the actuator piston 214 at an open end of the inner bore 310 and is configured with a central opening 314 that permits the actuator lash adjustment screw 306 to be slidably received within the central opening 314. An actuator piston spring 316 is disposed between shoulders 318, 320 respectively formed in the actuator lash adjustment screw 306 and the retainer 312, thereby tending to bias the retainer 312 and actuator piston 214 into the actuator piston bore 302.

A hydraulic fluid source is provided by a first hydraulic passage 322 formed in the rocker arm 202 in fluid communication between an output port of the control valve 211 and the actuator piston bore 302. Hydraulic fluid may be provided to the control valve 211 via passages formed in a rocker shaft and the rocker arm 202 using techniques known in the art. As further known in the art, the control valve provides a selectable means (via selectable application of hydraulic fluid thereto using, for example, a suitable solenoid controlled by an engine controller) for providing hydraulic fluid to the first hydraulic passage 322 or venting hydraulic fluid from any hydraulic circuits in fluid communication with the first hydraulic passage 322. Because, as described in greater detail below, the resetting assembly 218 provides another technique for evacuating hydraulic fluid, the venting capability of the control valve 211 is not a requirement. As such, the control valve 211, which otherwise includes a check valve disposed therein, may be replaced by a simple check valve operative permit hydraulic fluid to enter the first hydraulic passage 322, but not otherwise permit reverse flow of hydraulic fluid through the first hydraulic passage 322.

When pressurized hydraulic fluid is introduced into the first hydraulic passage 322 via the control valve 211 (or check valve) and, therefore, the actuator piston bore 302, the bias of the actuator piston spring 316 may be overcome by the hydraulic pressure acting upon the actuator piston 214, thereby causing the actuator piston 214 to extend out of the bore 302 until such time that a lower surface of the retainer 312 abuts an upper shoulder 324 of the actuator lash adjustment screw 306. In this manner, travel of the actuator piston 214 out of the actuator piston bore 302 is limited. Because the control valve 211 (or check valve) operates to check the hydraulic fluid in the actuator piston bore 302, a hydraulic lock is established that maintains extension of the actuator piston 214 out of the bore 302 notwithstanding application of any valve actuation motions to the rocker arm 202. However, in order to prevent overextension of the engine valves 222, the resetting assembly 218 is in fluid communication with the actuator piston bore 302 via a second hydraulic passage 326 that, as described in further detail below, allows the checked hydraulic fluid in the actuator piston bore 302 to be vented prior to the rocker arm 202 experiencing full lift of a main event valve actuation motion.

Figure 4:
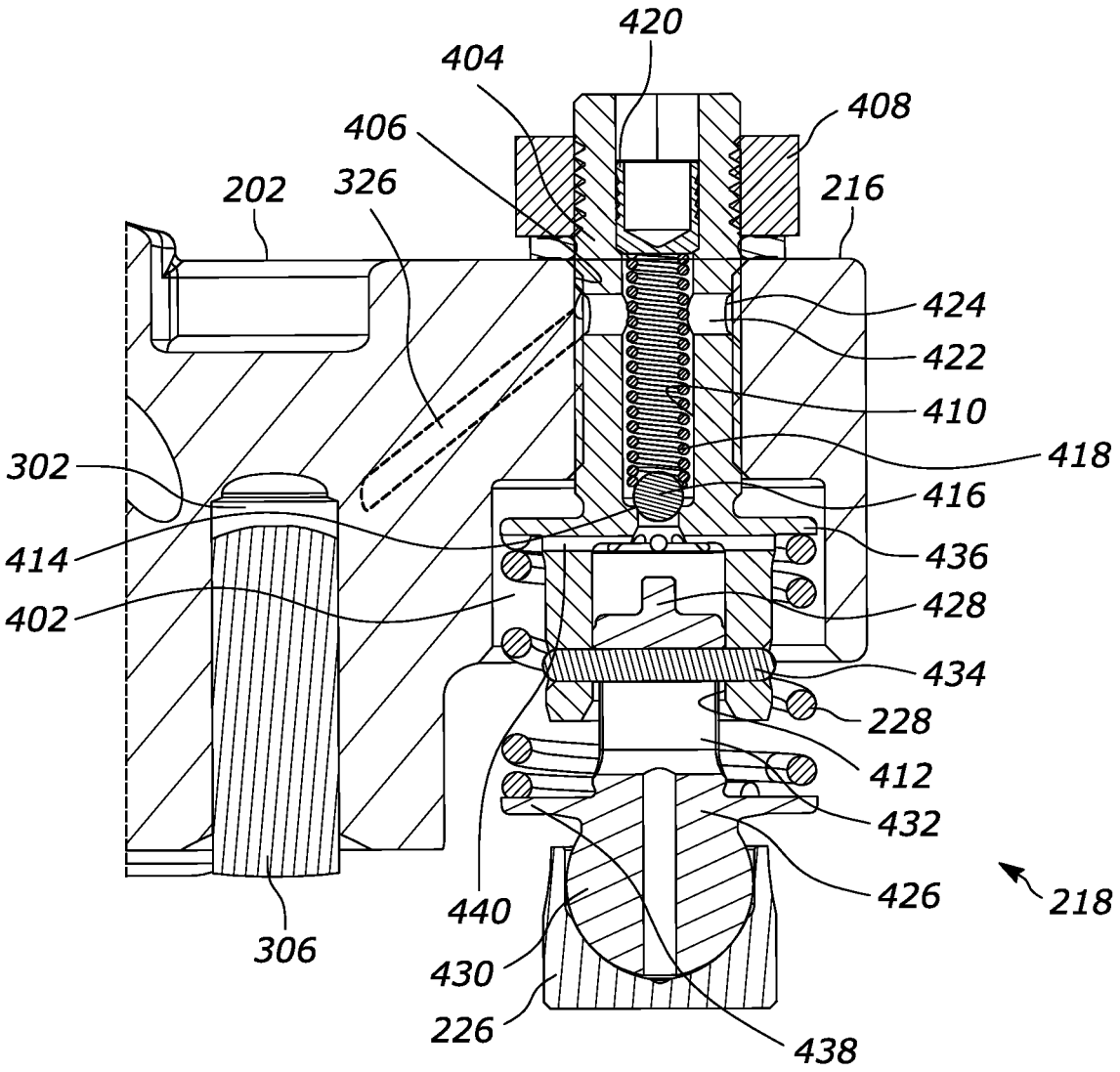

Referring now to FIG. 4, a partial cross-section illustrating additional detail of the lash/reset assembly boss 216 and resetting assembly 218 is shown. In particular, the lash/reset assembly boss 216 comprises a lash/reset assembly bore 402 having a downwardly facing open end and a lash adjustment assembly disposed therein. In an embodiment, the lash adjustment assembly comprises a lash adjustment screw 404 and a lash adjustment nut 408. A threaded opening 406 is provided at an end opposite the open end of the lash/reset assembly bore 402 and the lash adjustment screw 404 is threadedly engaged with the opening 406. As known in the art, the lash adjustment nut 408 is threadedly engaged with the lash adjustment screw 404 in order to maintain positioning of the lash adjustment screw 404 within the lash/reset assembly bore 402. The lash adjustment screw 404 has an internal bore comprising a first or smaller diameter bore 410 and a second or larger diameter bore 412 both longitudinally formed therein, with the respective bores 410, 412 in fluid communication with each other, though separated by, an opening or check seat 414 configured to receive a checking element. A feature of the instant disclosure is that the lash adjustment assembly, particularly the lash adjustment screw 404 in the illustrated embodiment, comprises the resetting assembly 218 that, in turn, comprises a checking element and reset slider 426, disposed therein as further described below.

In the illustrated example, the checking element comprises a check ball 416 disposed in the first bore 410 and biased into contact with the check seat 414 by a check spring 418 that reacts against a check spring retainer 420. Although a check ball arrangement is illustrated in FIGS. 4-10 as implementing the checking element, it is appreciated that other configurations, e.g., a check disk arrangement, may be equally employed as a matter of design choice.

The lash adjustment screw 404 comprises a radially extending bore 422 in fluid communication with the first bore 410 and an annular channel 424 formed on an external surface of the reset lash adjustment screw 404. The annular channel 424 is of sufficient longitudinal length so as to at least partially align with the second hydraulic passage 326 regardless of adjustments to the lash adjustment screw 404.

Figure 6:
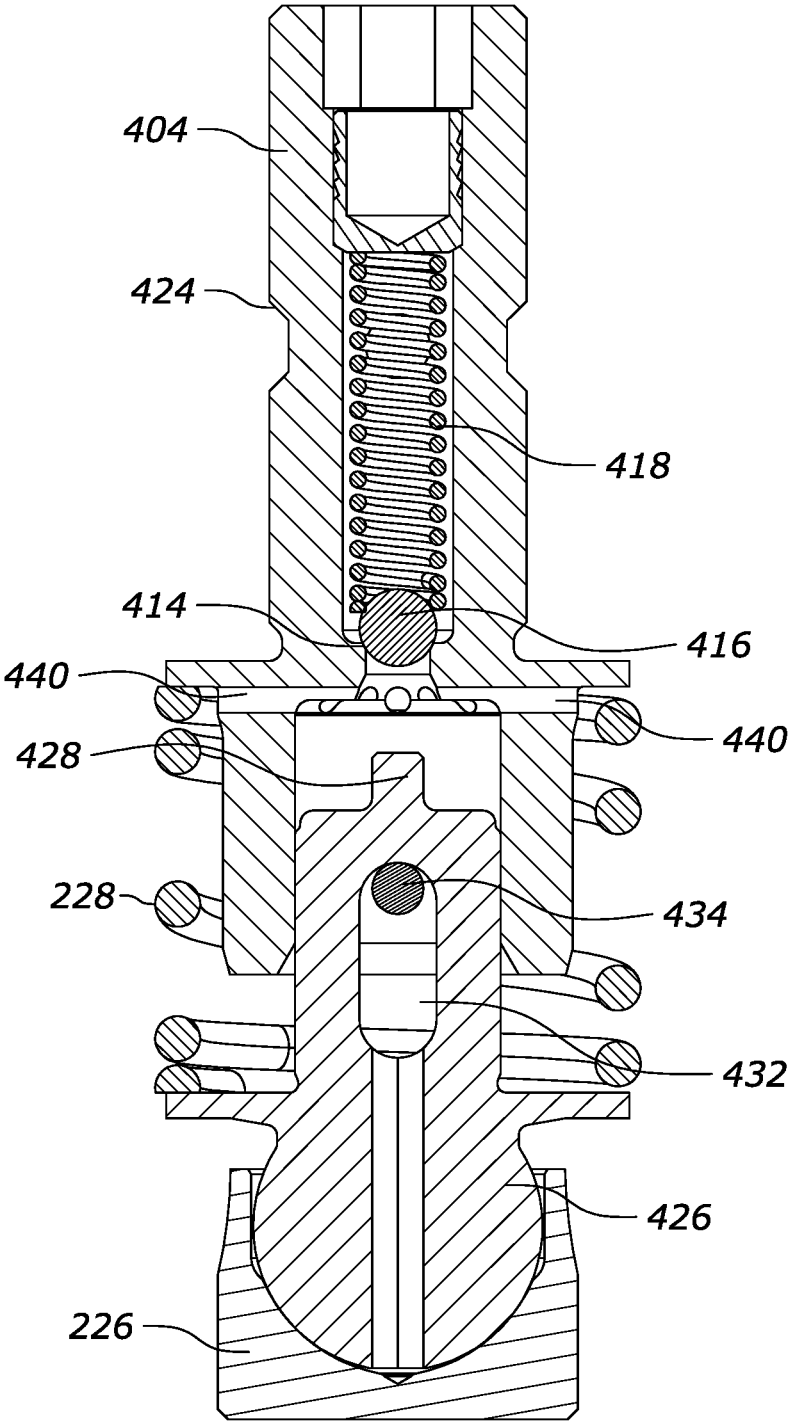
Figure 8:
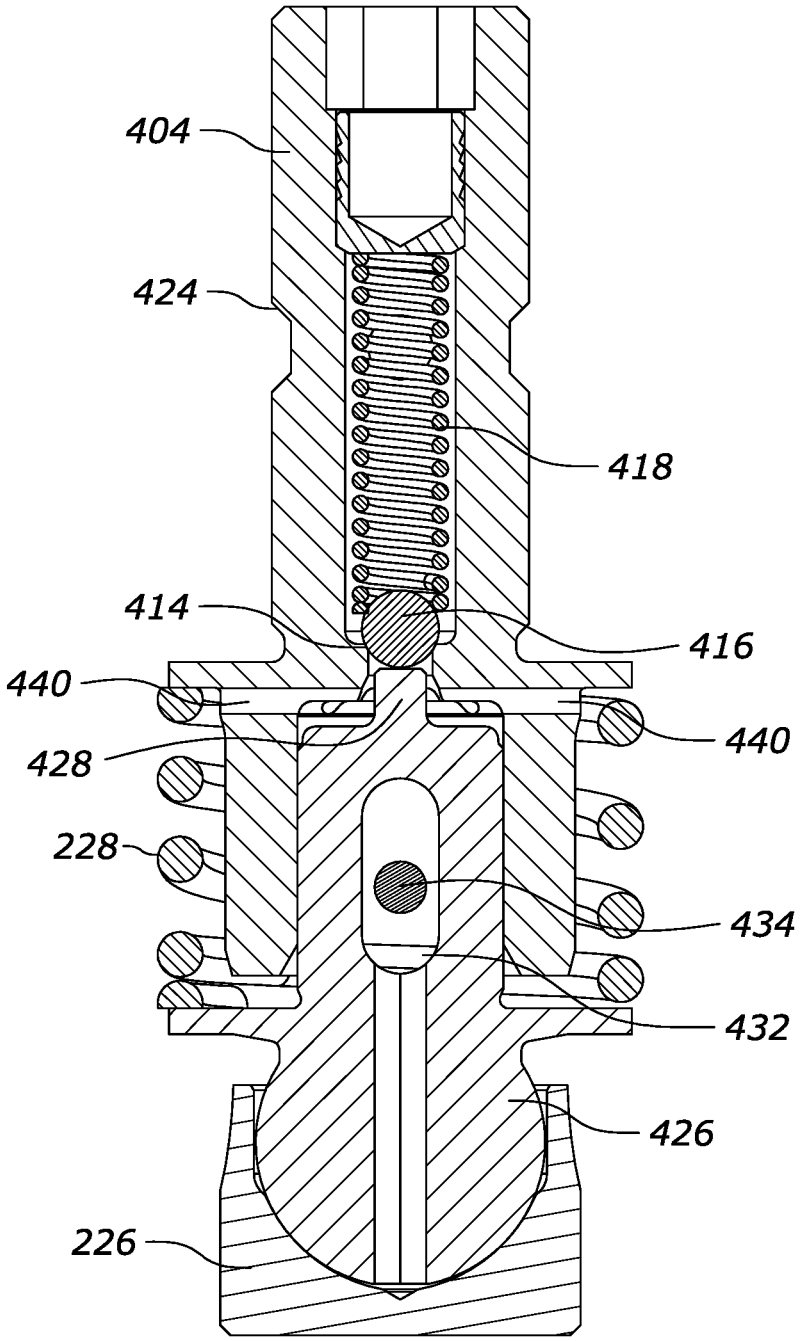
Figure 10:
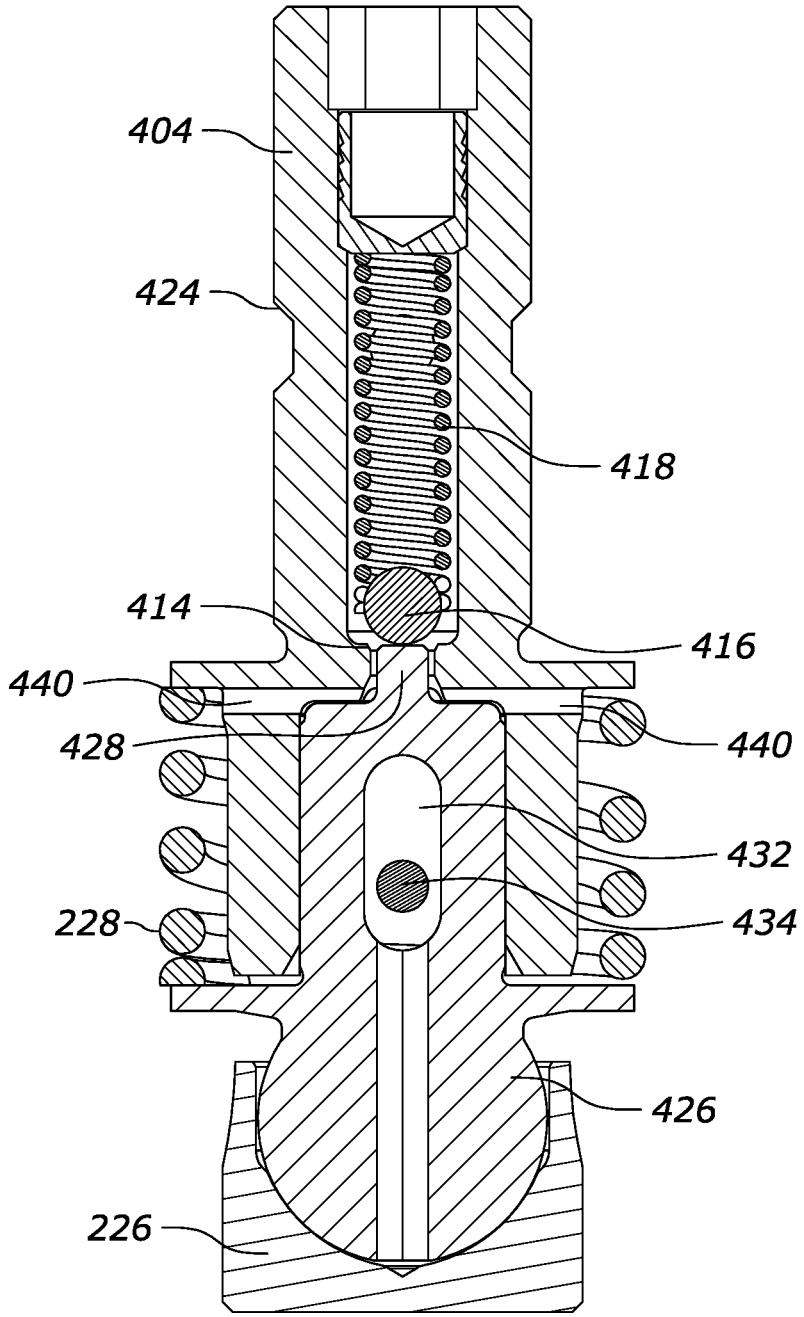

The reset slider 426 is slidably disposed in a downward facing open end of the second bore 412 and comprises a resetting pin 428 disposed on an upper surface of a second end of the reset slider 426 and aligned with the opening forming the check seat 414. As shown, the resetting pin 428 is integrally formed in the reset slider 426, though this is not a requirement, as it could also, for example, comprise a separate member that is attached to the reset slider 426 (e.g., in threaded fashion). At its other or first end, the reset slider 426 is configured to engage with a valve train component (e.g., the valve bridge 220; not shown) or an engine valve. For example, the first end of the reset slider 426 comprises a spherical end 430 with the e-foot 226 movably secured thereto. As best shown in FIGS. 6, 8 and 10, the reset slider 426 also comprises a diametrically and longitudinally extending notch 432, whereas the reset lash adjustment screw 404 comprises a transverse pin 434 diametrically spanning the second bore 412 and secured in openings formed in sidewalls of the lash adjustment screw 404. The transverse pin 434 passes through the notch 432 thereby securing the reset slider 426 to the lash adjustment screw 404 while still permitting the reset slider 426 to slide within the second bore 412.

In the illustrated embodiment, the biasing element 228, preferably in the form of a compression spring, is disposed between shoulders 436, 438 respectively formed in the lash adjustment screw 404 and the reset slider 426, thereby biasing the reset slider 426 away from the lash adjustment screw 404 and rocker arm 202, i.e., out of the second bore 412. The biasing element 228 is designed to provide a sufficient force such that, when the e-foot 226 contacts the valve train component or engine valve, the force provided by the biasing element 228 against the respective shoulders 436, 438 is sufficient to cause the rocker arm 202 to be biased into contact with the valve actuation motion source.

FIG. 4 also illustrates radially extending vent openings 440 located proximal to the check seat 414 that provide fluid communication between the first bore 412 and the ambient environment (as opposed to, for example, the hydraulic fluid source providing hydraulic fluid to the rocker arm 202 as in some prior art systems). As described in further detail below, when operation of the reset slider 426 causes the check ball 416 to be moved off of the check seat 414, hydraulic fluid from the actuator piston bore 302 is able to flow through the second hydraulic passage 326, annular channel 424, radial bore 422, first bore 410, check seat 414 and into the vent openings 440, thereby allowing the actuator piston 214 to retract.

Figure 5:
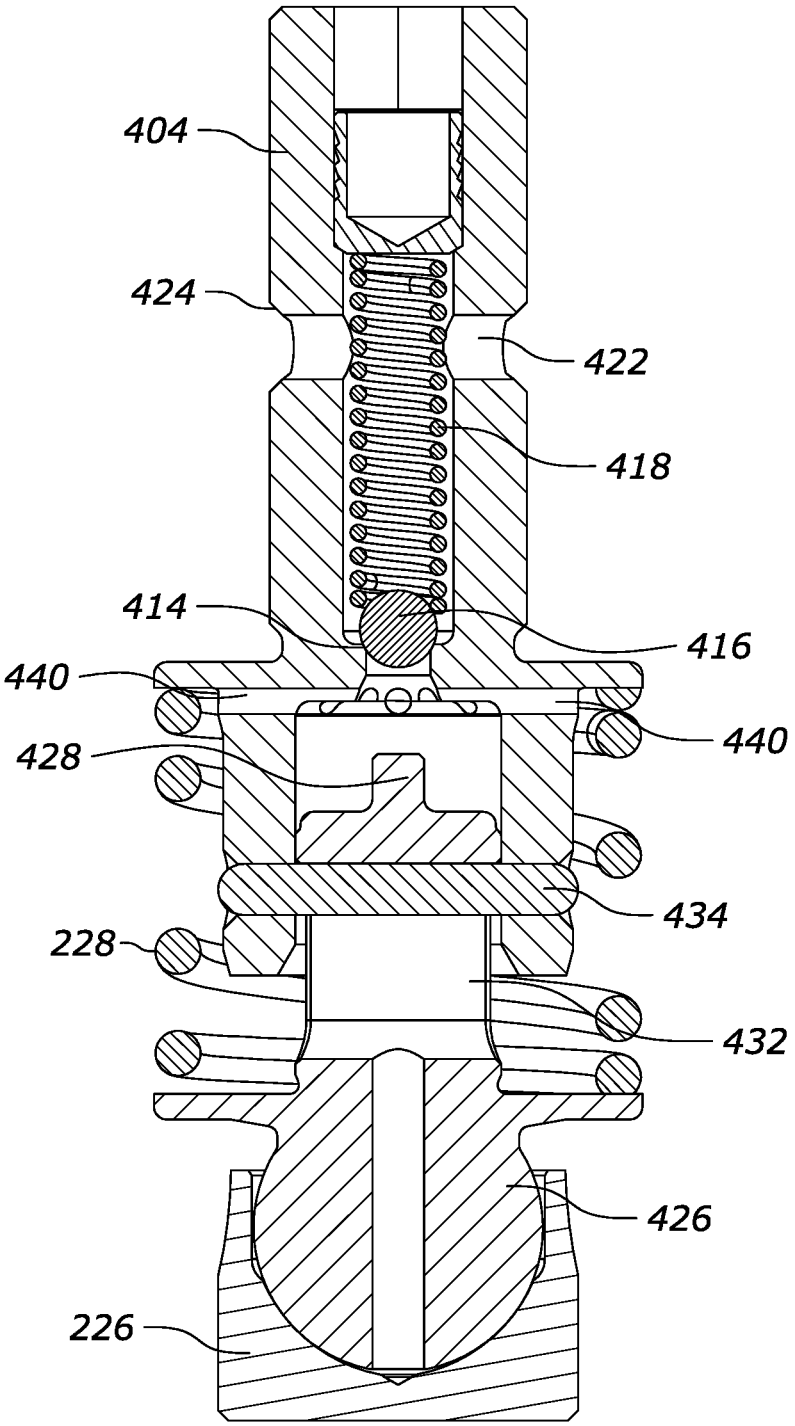
FIGS. 5-10 are elevational cross-section views of a portion of the resetting assembly of the rocker arm of FIG. 2 in accordance with the instant disclosure.
Figure 7:
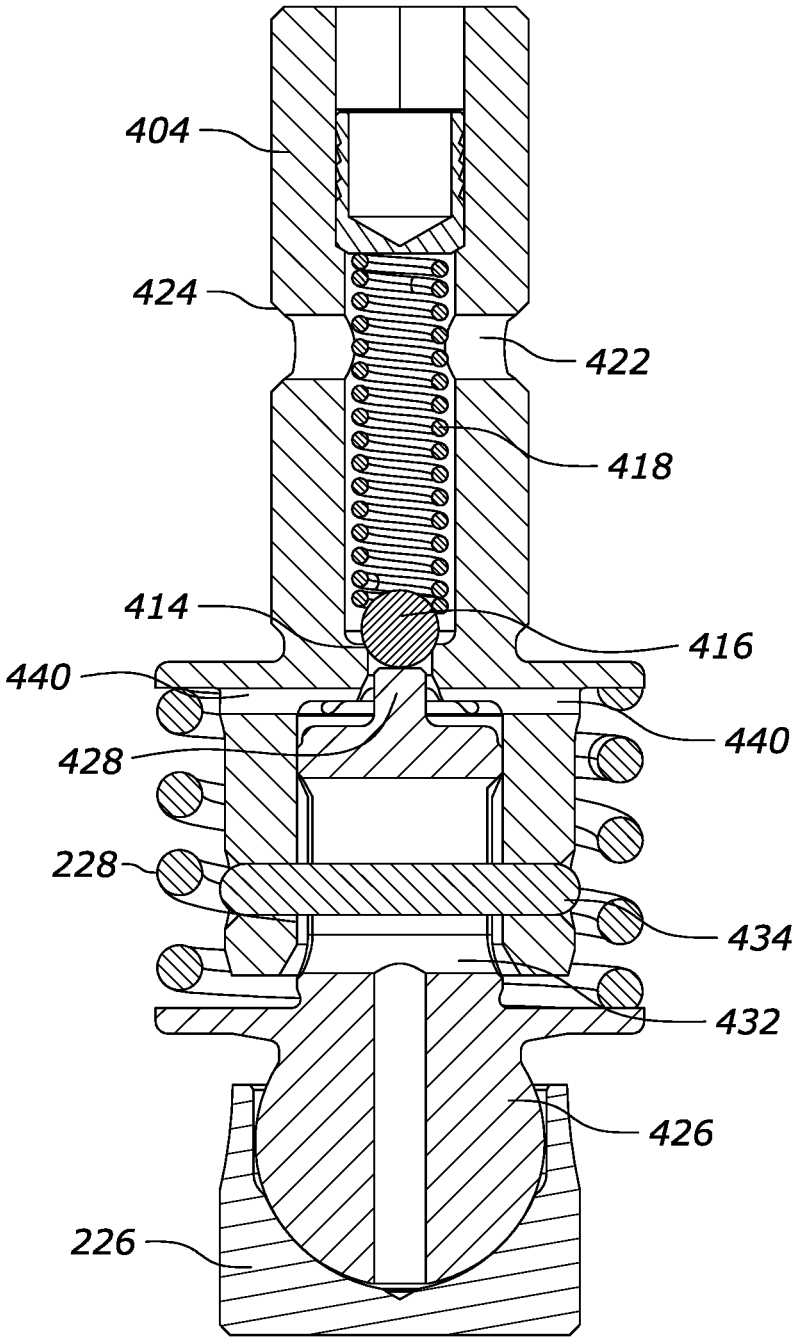
Figure 9:
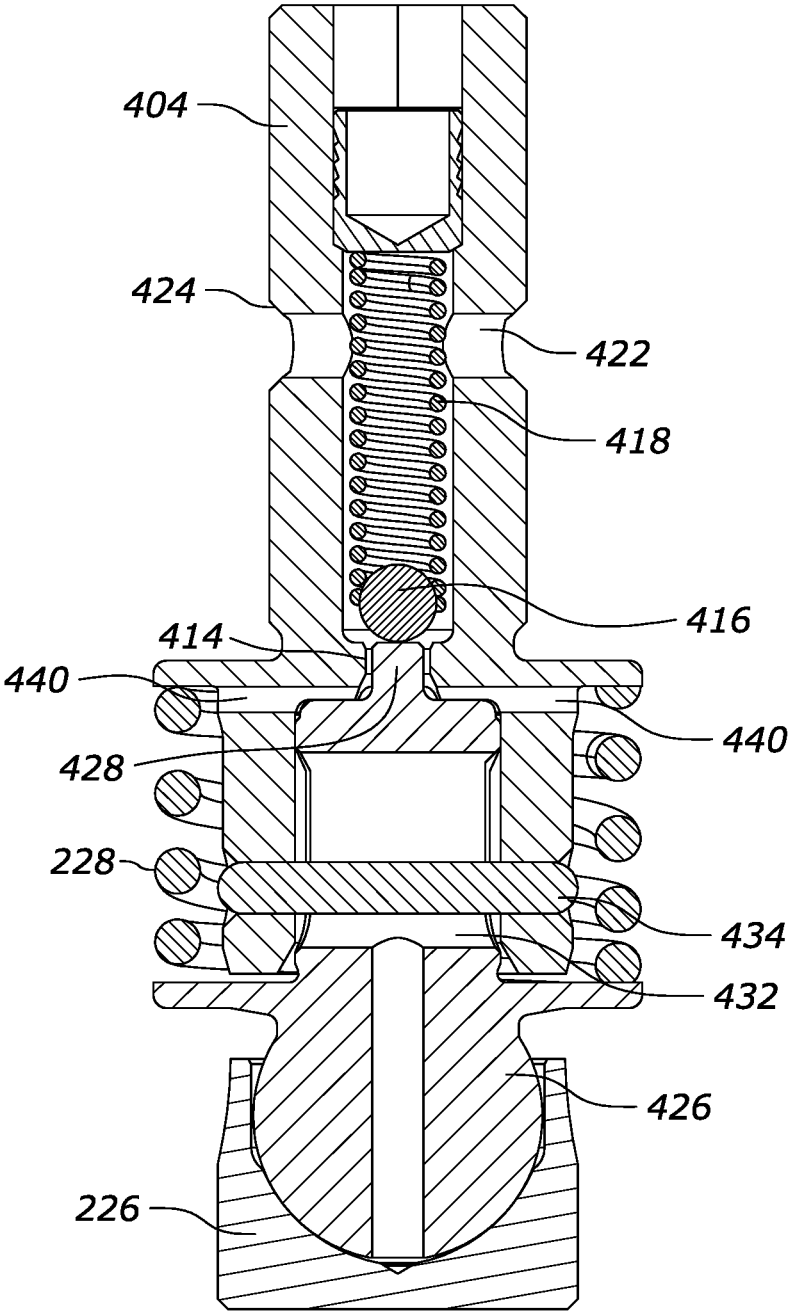

FIGS. 5-10 illustrate cross-sectional views of the lash adjustment screw 404, reset slider 426 and accompanying components throughout various stages of valve actuation motions being applied to the rocker arm 202 (not shown). In particular, FIGS. 5, 7 and 9 illustrate cross-sectional views taken along a plane parallel to the extent of the transverse pin 434 and notch 432, whereas FIGS. 6, 8 and 10 illustrate cross-sectional views taken along a plane perpendicular to the extent of the transverse pin 434 and notch 432 (i.e. along a plane that is orthogonal to the section plane in FIGS. 5, 7 and 9).

More particularly, FIGS. 4 and 5 illustrate the state in which no valve actuation motions (auxiliary or main event) are being applied to the rocker arm 202, i.e., the cam roller 210 is at the base circle 246 of the cam 240. In this state, the biasing element 228 biases the reset slider 426 away from the lash adjustment screw 404 such that the e-foot 226 contacts the valve bridge 220 or until travel of the reset slider 426 away from the lash adjustment screw 404 is limited by abutment of an upper surface of the notch 432 with the transverse pin 434. Note that, in this state, the resetting pin 428 is maximally separated from the check ball 416, which stays seated in its seat 414 under bias of the check spring 418, i.e., in a checked state. As a result, any charge of hydraulic fluid retained in the actuator piston bore 302 (as well as the second hydraulic passage 326 and first bore 410) remains hydraulically locked.

FIGS. 7 and 8 illustrate the state in which the maximum extent of any auxiliary valve actuation motions (as represented by the auxiliary cam lobes 244), or lower lift portions of a main event valve actuation motion (main cam lobe 244), have been applied to the rocker arm 202. In this state, the maximum auxiliary lift/lower main event lift causes downward travel (as depicted in FIGS. 7-10) of the lash adjustment screw 404 through rotation of the rocker arm 202. In turn, this causes the reset slider 426 (against the bias of the biasing element 228) to slide upward within the second bore 412. As the reset slider 426 slides upward, the resetting pin 428 enters the opening formed by the check seat 414 but does not cause the check ball 416 to lift off the seat. In this manner, maximum auxiliary lift/lower main event lift is absorbed by the resetting assembly 218 and, once again, any charge of hydraulic fluid retained in the actuator piston bore 302 (as well as the second hydraulic passage 326 and first bore 410) remains hydraulically locked. However, when the actuator piston bore 302 is charged with a locked volume of hydraulic fluid, this state of the rocker arm 202 will cause the rigidly extending actuator piston 214 to convey any auxiliary valve actuation motions to the corresponding engine valve as described above.

FIGS. 9 and 10 illustrate the state in which a main event lift (main cam lobe 244) applied to the rocker arm 202 has exceeded the maximum auxiliary lift (i.e., the limit established by the sub-base circle 248) thus causing the reset slider 426 to slide even further into the second bore 412 (but prior to the reset slider 426 bottoming out within the second bore 412) and causing the resetting pin 428 to contact the check ball 416 and overcome the bias of the check spring 418 (and any pressurized hydraulic fluid within the first bore 410). This, in turn, causes the check ball 416 to lift off of its seat 414. As the check ball 416 lifts off of its seat 414, and by virtue of a width of the resetting pin 428 being less than a width of the open 414 as shown, fluid communication is reestablished between the first bore 410 and the second bore 412 as well as the vent openings 440, thereby permitting the hydraulic fluid in the actuator piston bore 302 to rapidly vent. As described above, this venting of hydraulic fluid causes the actuator piston 214 to retract into its bore 302 and returns command of both engine valves back to the main event lift.

While the various embodiments in accordance with the instant disclosure have been described in conjunction with specific implementations thereof, it is evident that many alternatives, modifications and variations will be apparent to those skilled in the art. In the various embodiments described herein, the rocker arm is depicted as pivoting about a rocker shaft. However, the instant disclosure need not be limited in this regard, and it is understood that pivoting arrangements other than about a rocker shaft may be equally employed. For example, a portion of the disclosed rocker arm (e.g., an input portion comprising the motion receiving end) may pivot about different shafts. Further, such shafts could even be mounted on other portions of the rocker arms or on separate shaft pedestals.

As described above, the hydraulic fluid source (via the first hydraulic passage 322) is disclosed as being fluid connection with the actuator piston bore 302. However, it is appreciated that this is not a requirement. In fact, the hydraulic fluid source may be in fluid communication with any part of the hydraulic circuit formed by the actuator piston bore 302, hydraulic passage 326 and internal bore 410, 412.

Accordingly, the preferred embodiments of the invention as set forth herein are intended to be illustrative only and not limiting so long as the variations thereof come within the scope of the appended claims and their equivalents.

What is claimed is:

1. A rocker arm for actuating at least one engine valve in an internal combustion engine and having a motion imparting end, the rocker arm comprising:

an actuator piston slidably disposed in an actuator piston bore formed in the motion imparting end of the rocker arm;

a lash adjustment assembly disposed in the motion imparting end, the lash adjustment assembly comprising a lash adjustment screw including an internal bore;

a hydraulic passage in fluid communication with the actuator piston bore and the internal bore; and a resetting assembly disposed in the lash adjustment assembly, the resetting assembly comprising:

a checking element in fluid communication with the internal bore; and a reset slider slidably disposed in the internal bore, the reset slider including (i) a first end configured to engage a valve train component or a first engine valve of the at least one engine valve, and (ii) a second end including a resetting pin configured to force the checking element into an unchecked state in response to a positioning of the rocker arm when the first end engages the valve train component or the first engine valve, wherein the lash adjustment screw further includes a venting passage formed as a radially extending vent opening in fluid communication with the internal bore, the venting passage configured such that, in the unchecked state, hydraulic fluid in the actuator piston bore passes through the venting passage to an ambient environment.

2. The rocker arm of claim 1, wherein the actuator piston bore is configured to receive hydraulic fluid from a hydraulic fluid source.

3. The rocker arm of claim 2, wherein the hydraulic fluid source includes a check valve.

4. The rocker arm of claim 3, wherein the check valve is disposed within a control valve.

5. The rocker arm of claim 1, wherein the actuator piston is aligned with the first engine valve.

6. The rocker arm of claim 5, wherein the actuator piston is disposed at a position between the lash adjustment assembly and a motion receiving end of the rocker arm.

7. The rocker arm of claim 1, wherein the actuator piston is inwardly biased in the actuator piston bore.

8. The rocker arm of claim 1, wherein the lash adjustment screw is threadedly mounted in the rocker arm, the lash adjustment screw further including a radial bore in fluid communication with the internal bore so as to be aligned with the hydraulic passage.

9. The rocker arm of claim 8, wherein the internal bore includes a first bore and a second bore delimited from each other via an opening, wherein the radial bore is in fluid communication with the first bore, and wherein, in the checked state, the checking element is configured, to engage the opening so as to hydraulically isolate the first bore from the second bore.

10. The rocker arm of claim 9, wherein a width of the resetting pin is less than a width of the opening such that fluid communication between the first bore and the second bore is established when the checking element is in the unchecked state.

11. The rocker arm of claim 1, wherein the reset slider is configured to absorb at least a portion of valve actuation motions applied to the rocker arm before engaging the checking element.

12. The rocker arm of claim 11, wherein the reset slider is further configured to absorb auxiliary valve actuation motions applied to the rocker arm.

13. The rocker arm of claim 11, wherein the reset slider further includes a diametrically and longitudinally extending notch configured to define the portion of valve actuation motions absorbed by the reset slider.

14. The rocker arm of claim 13, wherein the lash adjustment assembly further comprises a transverse pin configured to engage the notch and limit at least some movement of the reset slider.

15. The rocker arm of claim 1, further comprising a biasing element configured to bias the reset slider out of the internal bore.

16. The rocker arm of claim 15, wherein the biasing element provides a bias sufficient to urge the rocker arm into contact with a valve actuation motion source when the reset slider engages the valve train component or the first engine valve.

17. The rocker arm of claim 1, wherein the at least one engine valve includes two engine valves, and wherein the valve train component is a valve bridge operatively connected to the two engine valves.

18. The rocker arm of claim 1, wherein the reset slider further includes an e-foot movably attached to the first end such that the first end is configured to contact the valve train component or the first engine valve via the e-foot.

* * * * *